US005541709A

United States Patent [19]

Wilcox

[11] Patent Number: 5,541,709

[45] Date of Patent: Jul. 30, 1996

[54] METHOD AND APPARATUS FOR CHANGING A DRUM SURFACE IN A PRINTING APPARATUS

[75] Inventor: Raymond D. Wilcox, Fairport, N.Y.

[73] Assignee: Xerox Corporation, Stamford, Conn.

[21] Appl. No.: 176,570

[22] Filed: Dec. 30, 1993

[51] Int. Cl.[6] ..... G03G 5/00

[52] U.S. Cl. ..... 355/212; 474/101

[58] Field of Search ..... 355/213, 210, 355/211, 212, 200; 492/47, 21; 474/101, 129, 120, 119; 198/813–816, 837

[56] References Cited

U.S. PATENT DOCUMENTS

| | | | |
|---|---|---|---|
| 3,480,361 | 11/1969 | Doi et al. | 355/213 |
| 3,695,757 | 10/1972 | Gregory | 355/211 X |
| 3,772,991 | 11/1973 | Taguchi et al. | 355/213 X |
| 3,974,974 | 8/1976 | Nishikawa | 355/213 X |
| 4,040,732 | 8/1977 | Hummel | 355/213 |
| 4,063,809 | 12/1977 | Schrempp et al. | 355/213 |
| 4,076,410 | 2/1978 | Kono et al. | 355/213 |
| 4,343,011 | 8/1982 | Murray et al. | 492/21 X |
| 4,626,095 | 12/1986 | Berger | 355/212 |
| 4,739,371 | 4/1988 | Ray et al. | 355/212 |
| 5,151,737 | 9/1992 | Johnson et al. | 355/211 |
| 5,255,056 | 10/1993 | Preszler et al. | 355/211 |
| 5,386,273 | 1/1995 | Wood et al. | 355/212 |
| 5,396,320 | 3/1995 | Lange | 355/211 X |

*Primary Examiner*—Arthur T. Grimley
*Assistant Examiner*—Shuk Y. Lee
*Attorney, Agent, or Firm*—Finnegan, Henderson, Farabow, Garrett & Dunner, L.L.P.

[57] ABSTRACT

An electrostatic copying machine including a drum that supports a photoreceptor belt. The drum includes a mechanism for reducing the drum perimeter, allowing a user to replace the photoreceptor belt.

4 Claims, 7 Drawing Sheets

METHOD AND APPARATUS FOR CHANGING A DRUM SURFACE IN A PRINTING APPARATUS

BACKGROUND OF THE INVENTION

1. Field of the Invention

The present invention relates to method and apparatus for changing a drum surface in a printing apparatus and more particularly to a method and apparatus for installing a flexible belt onto a relatively rigid drum in a printing apparatus such as an electrostatic printer.

2. Discussion of the Related Art

A typical document copier includes an electrostatic printer having a belt having a photoconductive surface. To transfer an image onto a sheet of paper, the printer charges the belt to a uniform potential, and then selectively exposes the belt to a pattern of light corresponding to the image. The light discharges parts of the belt resulting in a pattern of charge corresponding to the image, an electrostatic latent image, being formed on the belt. The portion of the belt having the electrostatic image then passes a development station that deposits toner on the belt in the pattern of the image, resulting in a developed image. A sheet of paper is then tacked onto the belt and removed from the belt, resulting in the image being formed on the paper.

A typical electrostatic printer includes rolls that drive the belt and that give the belt shape and support. These rolls are subject to motion in the direction of the rotation axis, or 'runout', and other variations that affect the otherwise uniform motion of the belt. Variations in uniform motion of the belt can adversely affect image quality. Thus, the belt requires tracking to suppress perpendicular motion of the belt relative to the upstream-to-downstream motion of the belt.

Problems caused by these variations in belt motion are exacerbated in single pass full color printers, which require especially accurate placement on the belt of overlying multiple images corresponding to each color component.

OBJECTS AND SUMMARY OF THE INVENTION

It is an object of the invention to provide a printing apparatus having an improved belt support system.

To achieve the object and in accordance with the purpose of the invention, as embodied and broadly described herein an assembly for use in a printing apparatus comprises a drum having a surface for supporting a belt, the drum including means for reducing a perimeter of the drum to allow the belt to be placed on the drum.

According to another aspect of the present invention, an assembly for a printing apparatus comprises a drum having a surface for supporting a belt, the drum including means for reducing a perimeter of the drum to allow the belt to be placed on the drum; means for developing an image on the belt; means for bringing a sheet of paper into contact with the belt.

According to yet another aspect of the present invention, an assembly for a printing apparatus comprises a drum having a surface for supporting a belt, the drum defining a slit; and means for changing a width of the slit.

According to yet another aspect of the present invention, an assembly for a printing apparatus comprises a drum having a surface for supporting a belt, the drum defining an aperture and including a door for closing the aperture.

BRIEF DESCRIPTION OF THE DRAWINGS

The accompanying drawings, which are incorporated in and which constitute a part of this specification, illustrate one embodiment of the invention and, together with the description, explain the principles of the invention. In the drawings.

DESCRIPTION OF THE PREFERRED EMBODIMENTS

Figure 1:
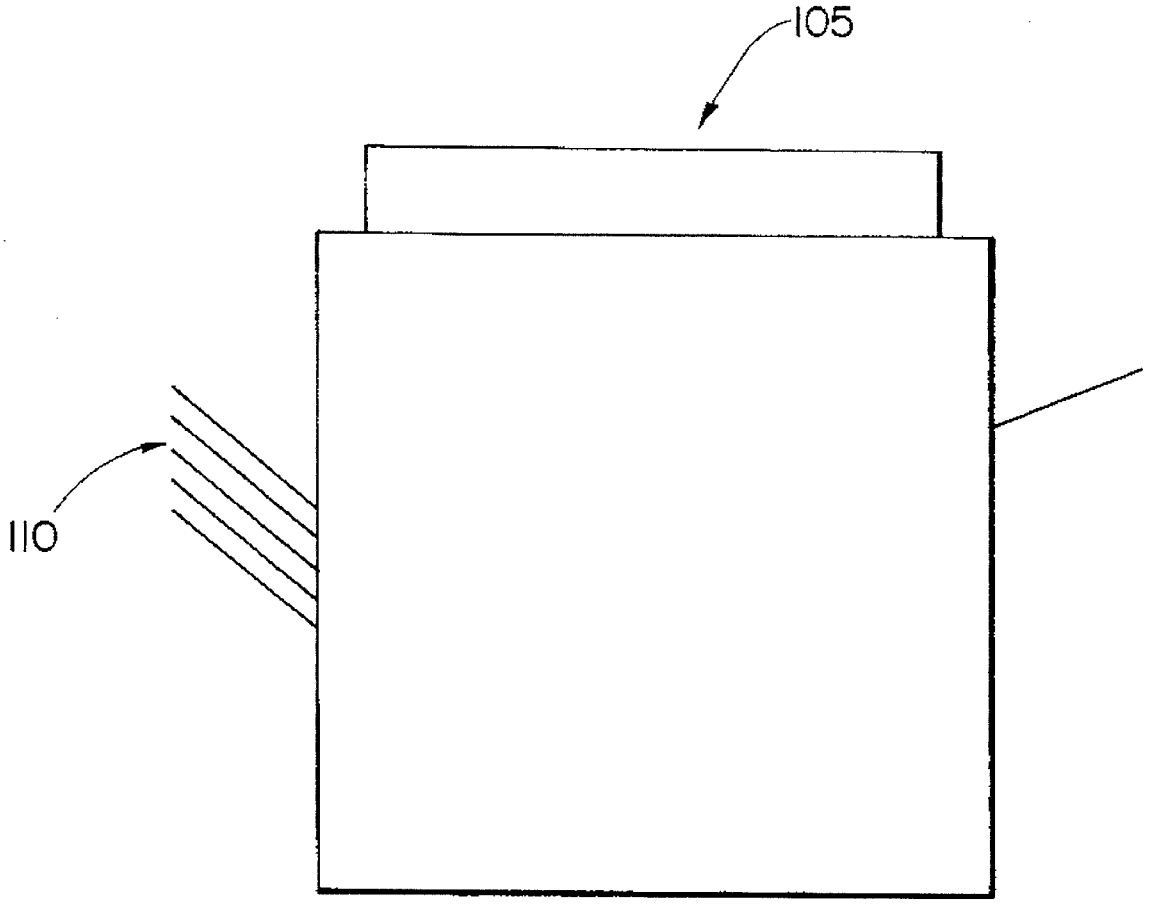
FIG. 1 is an external view of the copier of the preferred embodiments of the present invention.

As shown in FIG. 1, a copier 100 representing a preferred embodiment of the present invention includes a document feeder 105 for transporting an original document to a platen (not shown) where the copier 100 scans the original document. The copier 100 then duplicates the image of the original document onto a copy sheet and delivers the copy sheet to paper output trays 110.

Figure 2:
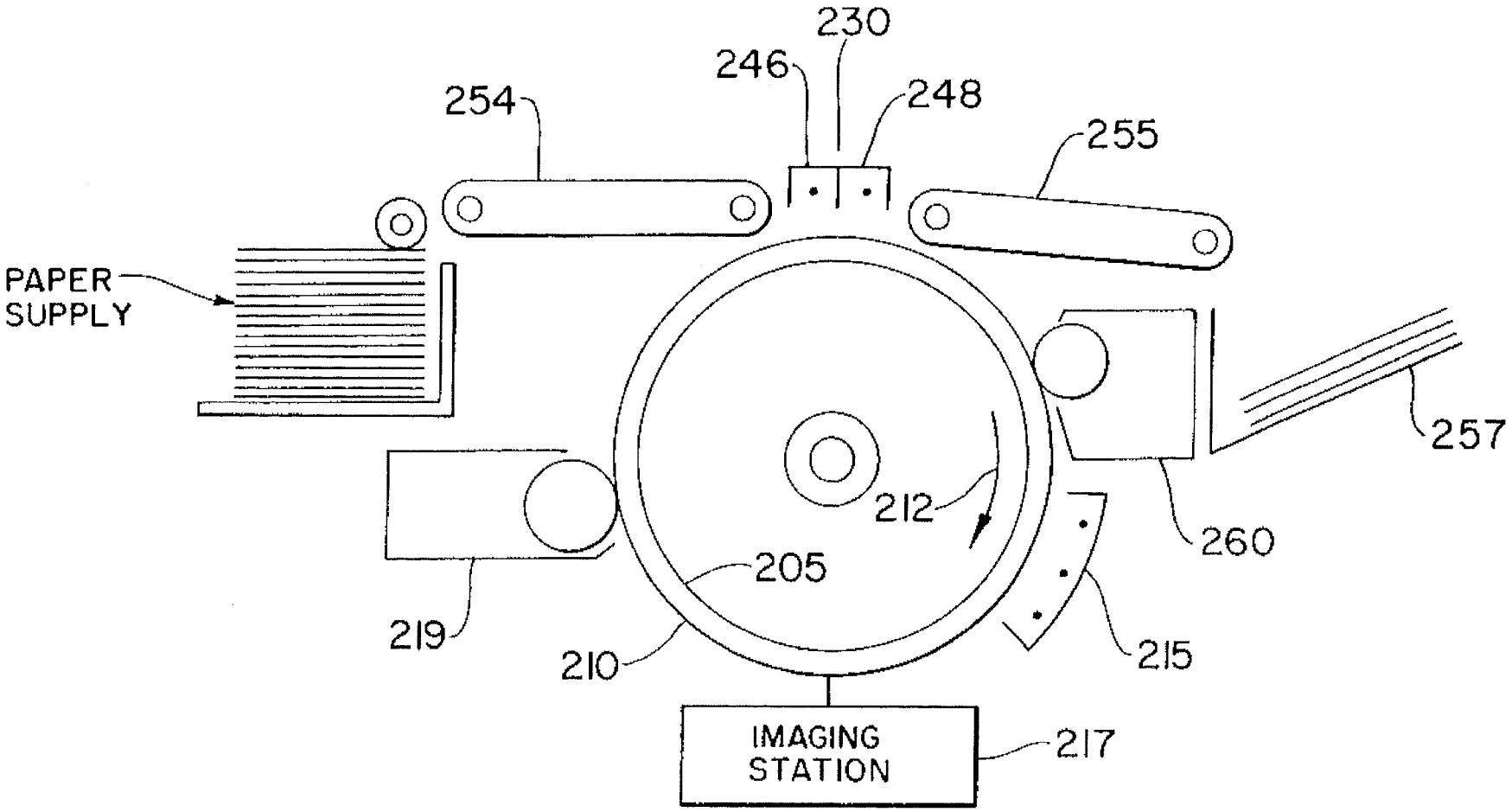
FIG. 2 is a schematic elevational view depicting various components of the copier shown in FIG. 1, according to a first embodiment of the present invention.

As shown in FIG. 2, the interior of the copier 100 shown in FIG. 1 includes a drum 205 supporting a photoreceptor belt 210. Drum 205 has a cylindrical shape and is composed of metal.

Photoreceptor belt 210 moves in the direction of arrow 212 to advance successive portions of belt 210 sequentially through the various processing stations disposed about the path of movement of belt 210. Initially a portion of belt 210 passes through charging station 215. Charging station 215 includes a corona device that charges a portion of belt 210 to a relatively high, substantially uniform potential, either positive or negative.

At imaging station 217, light rays from the original document are reflected through a lens and projected onto the charged portion of belt 210 to selectively dissipate the charge on belt 210. This selective discharge records an electrostatic latent image, corresponding to an image on the original document, on belt 210. Alternatively, a laser may be provided to selectively discharge belt 210 in accordance with stored electronic information.

Belt 210 then advances the electrostatic latent image to development station 219. Development station 219 includes a rotating magnetic member to advance developer mix, carrier beads and toner, into contact with the electrostatic latent image. The electrostatic latent image attracts toner particles from the carrier beads, thereby forming a toner powder image on belt 210.

Belt 210 then advances the toner powder image to transfer station 230, where a sheet of paper from conveyor 254 advances into contact with the toner powder image on belt 210. A corona generating device 246 charges the paper to a potential such that the paper becomes tacked onto the belt 210 and the toner powder image is attracted from the belt 210 to the paper. Subsequently, a corona generator 248 charges the paper causing the paper to be detached from belt 210 and transported by conveyor 255 to a fusing station (not shown).

A fusing station (not shown) includes a heated fuser roller and a backup roller, for contacting the toner powder images with the fuser roller, permanently affixed to the toner to the paper.

Cleaning station 260 removes residual toner particles remaining on belt 210.

Figure 3B:
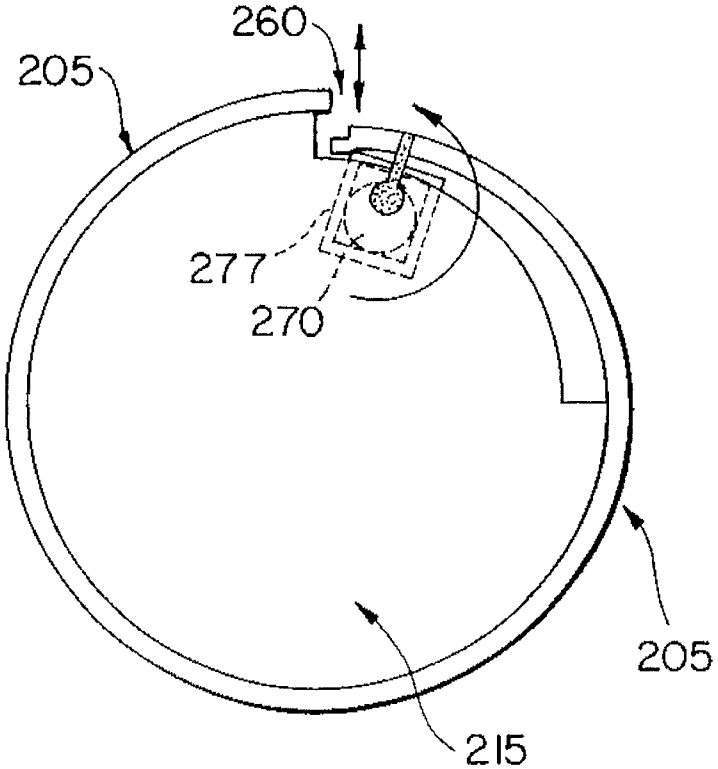
FIG. 3B is another enlarged end view of the drum component shown in FIG. 2 but in a different state.
Figure 3A:
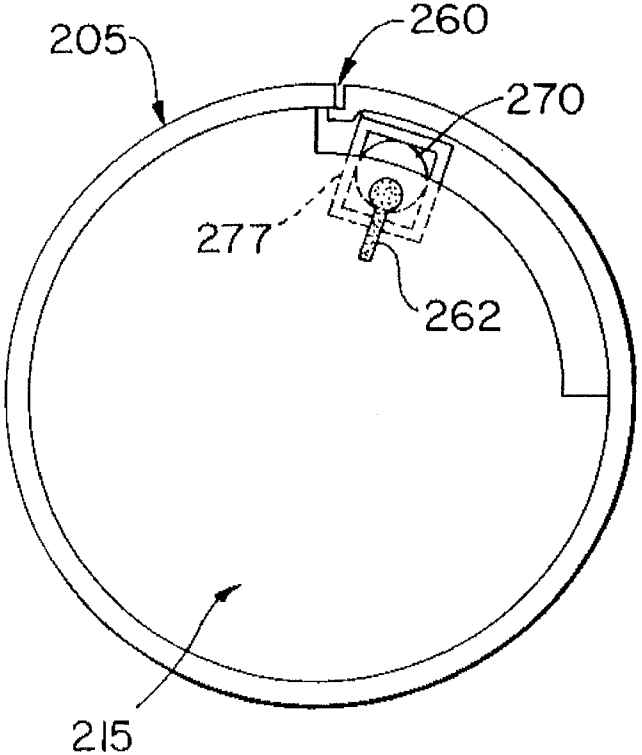
FIG. 3A is an enlarged end view of a drum component shown in FIG. 2.

As shown in FIGS. 3A and 3B, drum 205 includes a circular shell 206 having a slit 260 that spans the length of drum 205, an end plate 215, an actuator 277, a cam 270, and a lever 262. Drum 205 includes two end plates 215, one at each end of drum 205. FIG. 3A shows drum 205 in an uncompressed state and FIG. 3B shows drum 205 in a compressed state.

Slit 260 allows the shell 206 of drum 205 to be compressed when installing a new belt 210. As shown in FIGS. 3A and 3B, the shell of drum 205 is supported by end plate 215 at only approximately ¾ of the diameter of drum 205. Drum 205 is compressed in the ¼ portion of shell 206 that is not supported by end plate 215.

Figure 4:
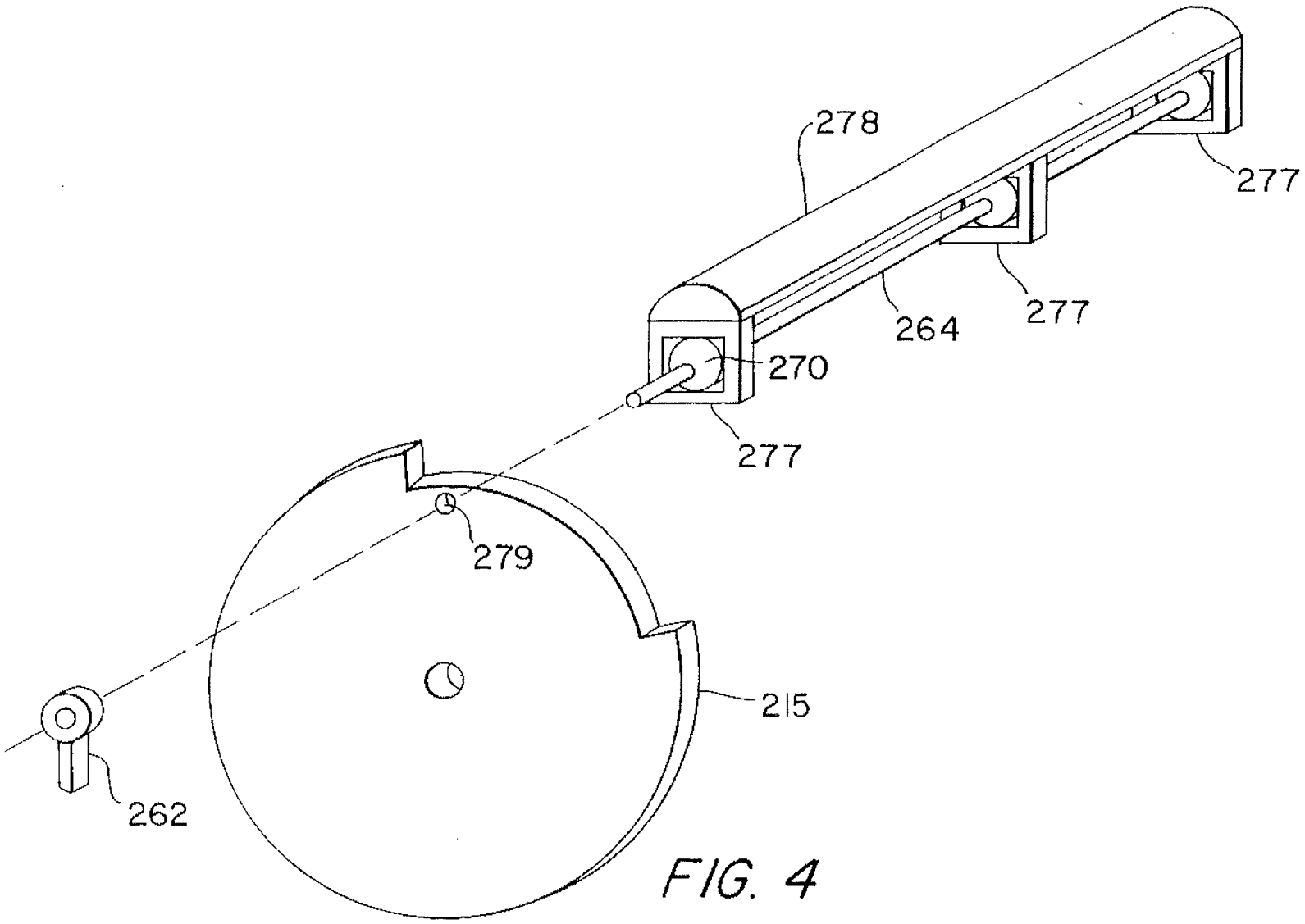
FIG. 4 is an exploded view showing some of the drum component of FIGS. 3A and 3B in more detail.

As shown in FIG. 4, drum 205 also includes a rod 264 that is rotatably mounted in hole 279 in each of the end plates 215. Lever 262 is mounted on rod 264. Crossbar 278 is attached to the inner surface of drum 205 along the entire length of drum 205.

To install a new belt 210, a user rotates rod 264 by rotating lever 262 to reduce the perimeter of drum 205, by compressing or flexing inward the unsupported portion of shell 206, until a latch (not shown) locks the mechanism in place. At this time, the user can slide off belt 210 and slide on a new belt. The user then releases the latch and drum 205 returns to its nominal perimeter. Because the nominal perimeter of belt 210 is slightly smaller than that of the drum 205, there is a tight fit between drum belt 210 and drum 205.

As shown in FIGS. 3A, 3B, and 4, rotation of rod 264 counterclockwise rotates cam 270, to exert a downward force on actuator 277. Actuator 277 then pulls down on drum 205 to decrease the perimeter of drum 205. Thus, cam 270 exerts a force colinear with crossbar 278 and the rotation axis of drum 205. The latch then locks the mechanism in this position.

Figure 5:
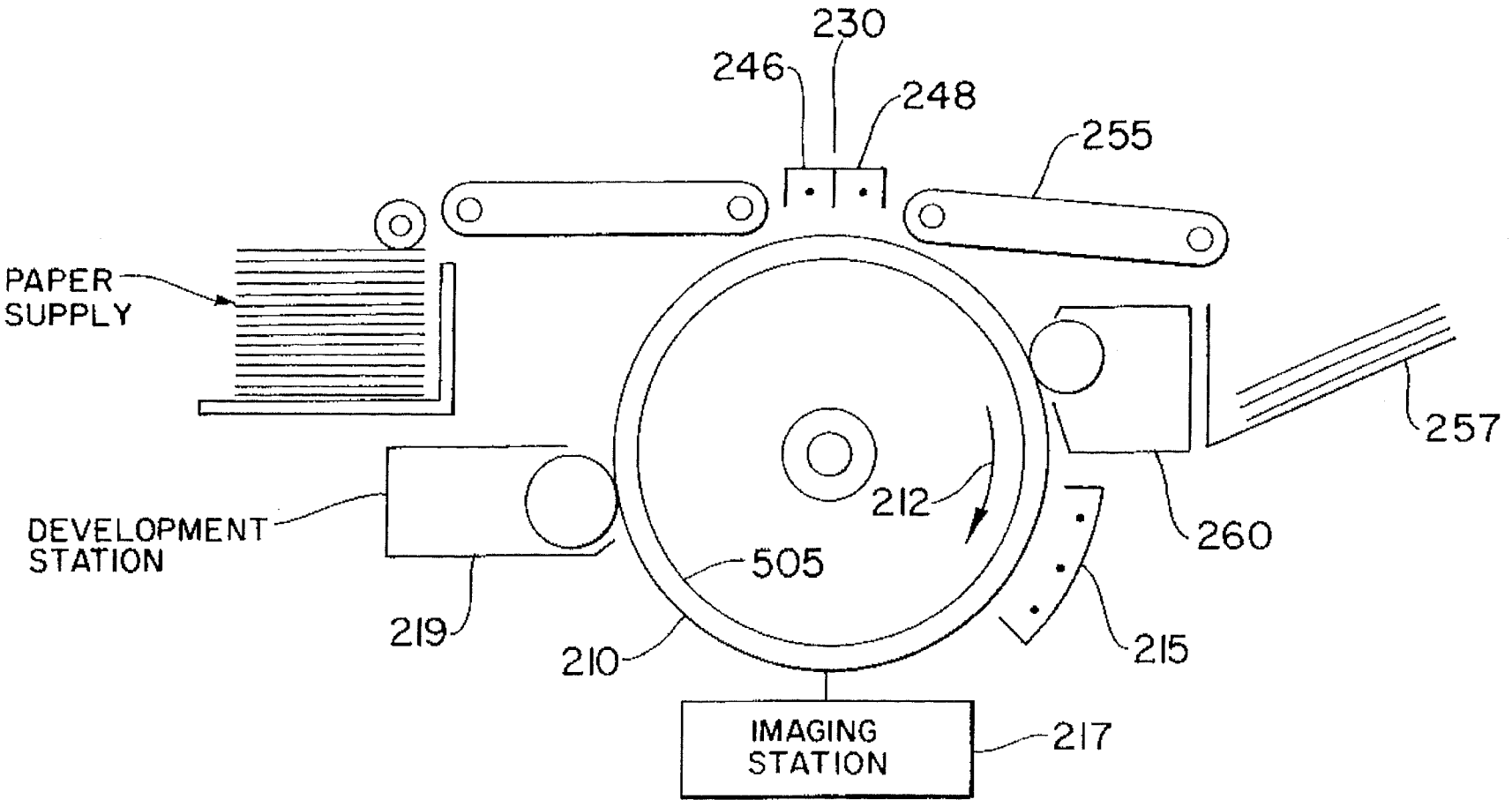
FIG. 5 is a schematic elevational view depicting various components of a copier according to a second embodiment of the present invention.

FIG. 5 shows the interior of a copier 100 according to a second embodiment of the present invention. Elements corresponding to the elements of the first embodiment of the invention are labeled with corresponding reference numbers. The printing process of the second preferred copier is similar to the printing process of the first preferred copier described above.

Figure 6:
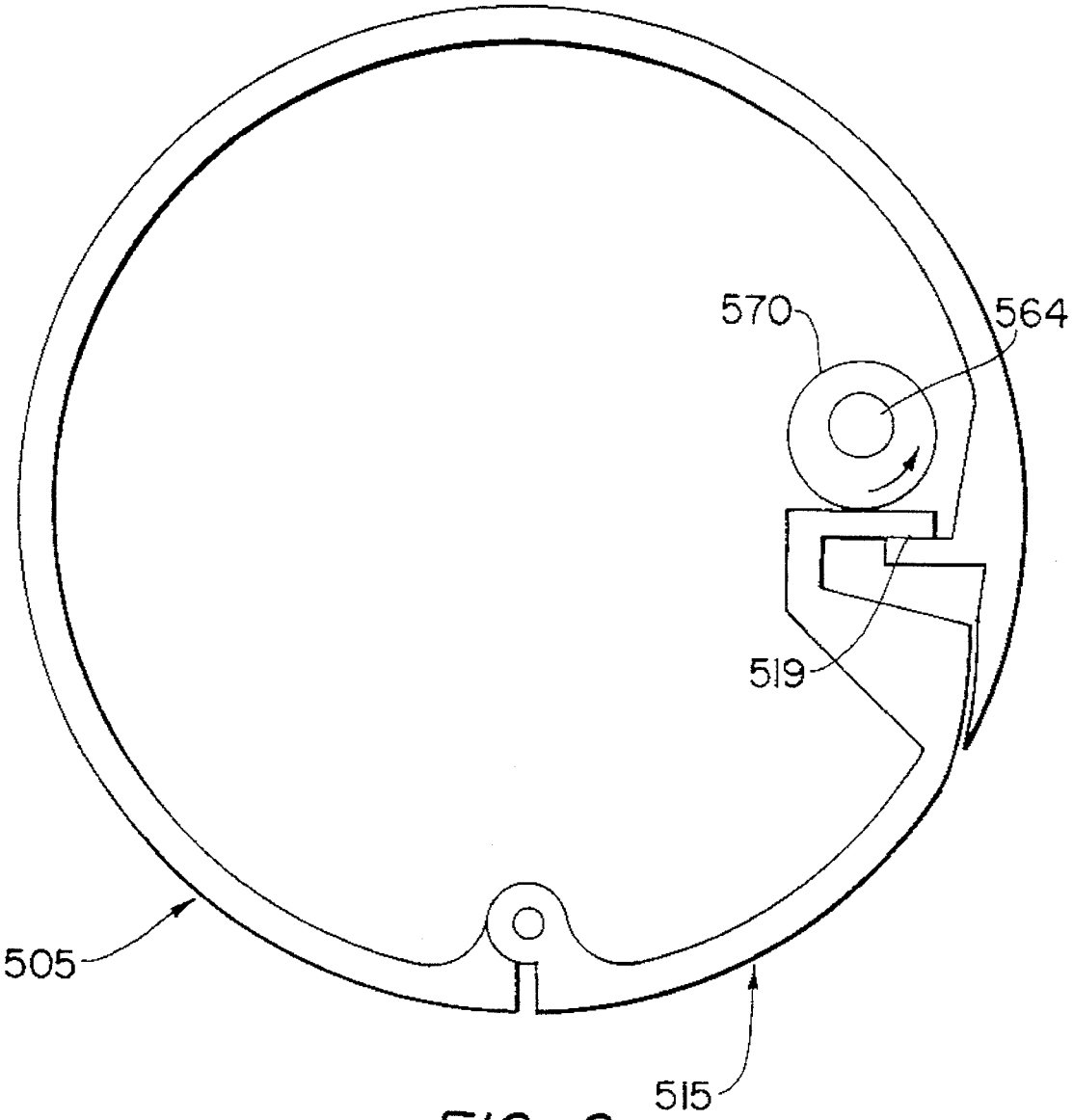
FIG. 6 is a schematic end view showing a portion of the components shown in FIG. 5, according to the second embodiment of the present invention.

The second preferred copier includes a drum 505. FIG. 6 shows drum 505 including a door 515, a knob 564, and a cam 570. Door 515 spans the length of drum 208. FIG. 6 shows door 515 in the closed position. Opening door 515 removes a section of drum 505 thus decreasing the total circumference of drum 505 to accommodate the removal and installation of a new belt 210. Because door 515 defines an arc that is equivalent to the radius of the drum 505, drum 505 is substantially round when door 515 is in the closed position.

Figure 7:
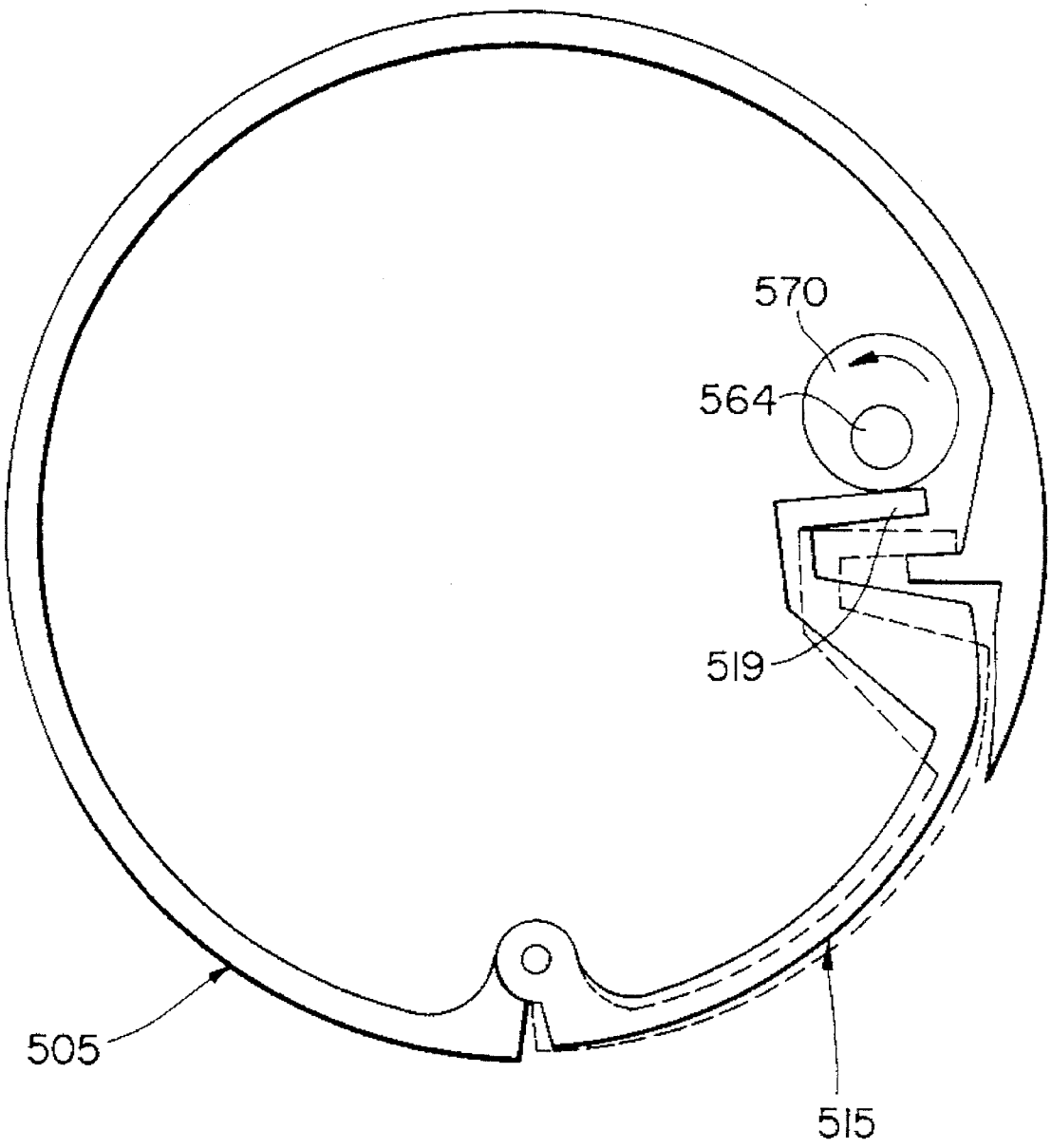
FIG. 7 is another schematic end view showing a portion of the components shown in FIG. 5, according to the second embodiment of the present invention.

FIG. 7 shows drum 505 with the door 515 in the open position.

When a user wishes to install a new belt 210, the user rotates rod 564 counterclockwise, to rotate cam 570, which releases door 515. Door 515 is now free to be opened, thus decreasing the circumference of the drum 505. This decreased circumference allows the operator to slip a new belt 210 onto drum 505. The user then rotates rod 564 clockwise, locking door 515 in place. When in the locked position, drum 505 returns to its nominal circumference, which is slightly larger than that of the belt 210, thus resulting in a tight fit between the belt 210 and drum 505.

As shown in FIGS. 6 and 7, the drum has an inwardly directed flange 518 to define a radial docking surface 519. The free end of the door 515 has a complementing radial flange 520 to engage docking surface 519. Cam 570 is located to push flange 520 against the docking surface 519 in a direction substantially parallel to the nearest part of the outer surface of drum 505. This parallel force avoids deformation that would occur if the force were applied out instead of parallel. This parallel force results from the cam having the first outer portion engaging door 515, and a second outer portion opposed to the first outer portion, wherein the first and second outer portions have a common distance from the rotation axis of drum 505. The first and second outer portions need not be exactly opposite on cam 570. It is sufficient if the smallest angle defined by the center of the cam and the first and second outer portions is greater than 90°.

Thus, the copiers of the preferred embodiment of the present invention support a photoreceptor belt on a rigid drum to move the belt with uniform motion and avoid the motion variation problem of the prior art, thereby resulting in a high quality copy image. The preferred copiers provides a mechanism that allows the user to easily replace the photoreceptor belt.

Additional advantages and modifications will readily occur to those skilled in the art. The invention in its broader aspects is therefore not limited to the specific details, representative apparatus, and illustrative examples shown and described. Various modifications and variations can be made to the present invention without departing from the scope or spirit of the invention, and it is intended that the present invention cover the modifications and variations provided they come within the scope of the appended claims and their equivalents.

We claim:

1. A belt-supporting drum for use in a printing apparatus, the drum comprising:

a drum shell of normally circular shape and defining a drum perimeter, the drum shell having a surface for supporting a belt and having a slit extending axially of the drum, and means for moving inwardly from a closed position corresponding to said normally circular shape, a portion of the drum shell adjacent to the slit, thereby reducing the drum perimeter to facilitate placement of the belt on the drum;

wherein the drum comprises a pair of end plates for supporting the drum shell, a portion of said end plates having a reduced radius to allow the inward movement of the drum shell portion adjacent to the slit.

2. The belt supporting drum of claim 1 having a drum length, the moving means comprising a cross bar attached to the portion of the drum shell inner surface near the slit along the drum length, and cam means positioned within the cross bar and journalled in the end plates for drawing the cross bar inwardly.

3. A belt-supporting drum for use in a printing apparatus, the drum comprising:

a drum shell of normally circular shape and defining a drum perimeter, the drum shell having a surface for supporting a belt and having a slit extending axially of the drum, and means for moving inwardly from a closed position corresponding to said normally circular shape, a portion of the drum shell adjacent to the slit, thereby reducing the drum perimeter to facilitate placement of the belt on the drum;

wherein the portion of the drum shell adjacent to the slit is a single arcuate door, of an arcuate length substantially less than fifty percent of the perimeter of the entire drum in normal position, pivoted for inward movement relative to the drum shell.

4. A belt-supporting drum for use in a printing apparatus, the drum comprising: a drum shell of normally circular shape and defining a drum perimeter, the drum shell having a surface for supporting a belt and having a slit extending axially of the drum, and means for moving inwardly from a closed position corresponding to said normally circular shape, a portion of the drum shell adjacent to the slit, thereby reducing the drum perimeter to facilitate placement of the belt on the drum;

wherein the portion of the drum shell adjacent to the slit is an arcuate door pivoted for inward movement relative to the drum shell;

wherein the arcuate door has a free end with an outwardly directed flange, the drum shell having an inwardly directed flange to define a radial docking surface, and further comprising a cam for urging said outwardly directed flange against said docking surface when said door is in said closed position.

* * * * *